US012228315B2

(12) United States Patent
Okuda et al.

(10) Patent No.: US 12,228,315 B2
(45) Date of Patent: Feb. 18, 2025

(54) HEAT PUMP

(71) Applicant: Yanmar Power Technology Co., Ltd., Osaka (JP)

(72) Inventors: Norihiro Okuda, Osaka (JP); Hideshi Okada, Osaka (JP); Sachie Tsujikawa, Osaka (JP); Terunori Aikawa, Osaka (JP); Tomoya Yoshimura, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 218 days.

(21) Appl. No.: 17/913,999

(22) PCT Filed: Mar. 4, 2021

(86) PCT No.: PCT/JP2021/008359
§ 371 (c)(1),
(2) Date: Sep. 23, 2022

(87) PCT Pub. No.: WO2021/192884
PCT Pub. Date: Sep. 30, 2021

(65) Prior Publication Data

US 2023/0135687 A1 May 4, 2023

(30) Foreign Application Priority Data

Mar. 25, 2020 (JP) ..... 2020-053960

(51) Int. Cl.
*F25B 31/00* (2006.01)
*F25B 30/02* (2006.01)
(Continued)

(52) U.S. Cl.
CPC ..... *F25B 31/004* (2013.01); *F25B 30/02* (2013.01); *F25B 41/20* (2021.01); *F25B 43/02* (2013.01);
(Continued)

(58) Field of Classification Search
CPC .... F25B 31/004; F25B 43/02; F25B 2500/16; F25B 43/006
See application file for complete search history.

(56) References Cited

U.S. PATENT DOCUMENTS 5,369,958 A * 12/1994 Kasai ..... F25B 13/00 62/196.3

FOREIGN PATENT DOCUMENTS

JP 9-287834 A 11/1997
JP H09287834 A 11/1997
(Continued)

OTHER PUBLICATIONS

International Search Report dated Apr. 6, 2021 issued in corresponding PCT Application PCT/JP2021/008359 cites the patent documents above.

(Continued)

*Primary Examiner* — Ana M Vazquez
(74) *Attorney, Agent, or Firm* — NORTON ROSE FULBRIGHT US LLP

(57) ABSTRACT

A heat pump is provided with a compressor; an oil separator provided on a discharge path of the compressor; an accumulator connected to the compressor via a suction path; and a bypass circuit configured to supply a gas refrigerant separated by the oil separator. The bypass circuit is connected to the suction path.

5 Claims, 4 Drawing Sheets

(51) Int. Cl.
*F25B 41/20* (2021.01)
*F25B 43/02* (2006.01)

(52) U.S. Cl.
CPC ... *F25B 2400/0401* (2013.01); *F25B 2500/06* (2013.01); *F25B 2500/16* (2013.01); *F25B 2500/26* (2013.01)

(56) References Cited

FOREIGN PATENT DOCUMENTS

| | | | |
|---|---|---|---|
| JP | 2004-085036 | A | 3/2004 |
| JP | 2006-112668 | A | 4/2006 |
| JP | 2012-077971 | A | 4/2012 |
| JP | 2016-173201 | A | 9/2016 |
| WO | 2012/002498 | A1 | 1/2012 |

OTHER PUBLICATIONS

Japanese Office Action dated Oct. 4, 2022 issued for JP Application No. 2020053960.

* cited by examiner

HEAT PUMP

CROSS-REFERENCE TO RELATED APPLICATIONS

This application is a national stage application pursuant to 35 U.S.C. § 371 of International Application No. PCT/JP2021/008359, filed on Mar. 4, 2021 which claims priority under 35 U.S.C. § 119 to Japanese Patent Application No. 2020-053960 filed on Mar. 25, 2020, the disclosures of which are hereby incorporated by reference in their entireties.

TECHNICAL FIELD

The present invention relates to a heat pump including an accumulator connected to a compressor.

BACKGROUND ART

Conventionally, it is known in a heat pump that if there is a liquid refrigerant around a compressor when the compressor gets started, it is concerned that the compressor is damaged by the liquid refrigerant. To suppress such a problem, a method of providing a heater on the compressor to warm up the compressor has been proposed (see, for example, Patent Literature 1).

CITATION LIST

Patent Literature

Patent Literature 1: Japanese Patent Laid-Open Publication No. 2016-173201

DISCLOSURE OF INVENTION

Problems to be Solved by the Invention

The heat pump disclosed in Patent Literature 1 is provided with a compressor and a heater for the compressor, and an alarm is notified when an energization duration period of the heater for the compressor elapses a predetermined time. In addition, an accumulator is provided in a suction path of the compressor. In the heat pump mentioned above, it is often the case where while a system is turned off, oil in the accumulator accumulates in a piping connecting the compressor and the accumulator via an orifice. In such an event, there is a problem that if turning on the heat pump, the oil accumulated in the piping flows into the compressor as an oil lump, so that it causes the compressor to be damaged.

The present invention is made to solve the problem mentioned above, and an object of the invention is to provide a heat pump capable of preventing a compressor from being damaged by delivering hot gas together with a refrigerant when turning on the system.

Means for Solving the Problems

A heat pump according to the present invention includes: a compressor; an oil separator provided in a discharge path of the compressor; and an accumulator connected to the compressor via a suction path, wherein a bypass circuit to deliver a gaseous refrigerant separated with the oil separator is provided, and the bypass circuit is connected to the suction path.

The heat pump according to the present invention may be configured such that a valve is provided in the bypass circuit, and the valve is controlled so that a degree of opening of the valve is decreased over time after the heat pump is started.

The heat pump according to the present invention may be configured such that a first piping to deliver oil separated with the oil separator to the compressor is provided, and the first piping is connected to the suction path above the accumulator in a vertical direction.

The heat pump according to the present invention may be configured such that the suction path has an upward extending part extending upward, a downward extending part extending downward, and a connection part to connect the upward extending part and the downward extending part, the upward extending part, the connection part, and the downward extending part are provided in the suction path in a stated order from an upstream side along a delivery direction of a refrigerant, and the first piping is connected to the upward extending part.

The heat pump according to the present invention may be configured such that the suction path has a plurality of paths and a branch part that connects to the plurality of paths, a second piping to return oil to the accumulator is connected to the branch part, and the second piping is connected to the suction path below the first piping in the vertical direction.

The heat pump according to the present invention may be configured such that a filter is housed in the branch part.

The heat pump according to the present invention may be configured such that an oil path through which oil delivered from the oil separator flows and an oil sensor to detect an amount of oil flowing through the oil path are provided, and the oil path is connected to the bypass circuit.

Effect of the Invention

According to the present invention, even if oil is stored in a piping of the accumulator when getting started, since the gaseous refrigerant flowing in from the bypass circuit is mixed with oil, this makes it possible to prevent oil from rushing into the compressor and damaging the same.

DESCRIPTION OF EMBODIMENTS

Now, a heat pump according to an embodiment of the present invention will be described below with reference to the drawings.

Figure 1:
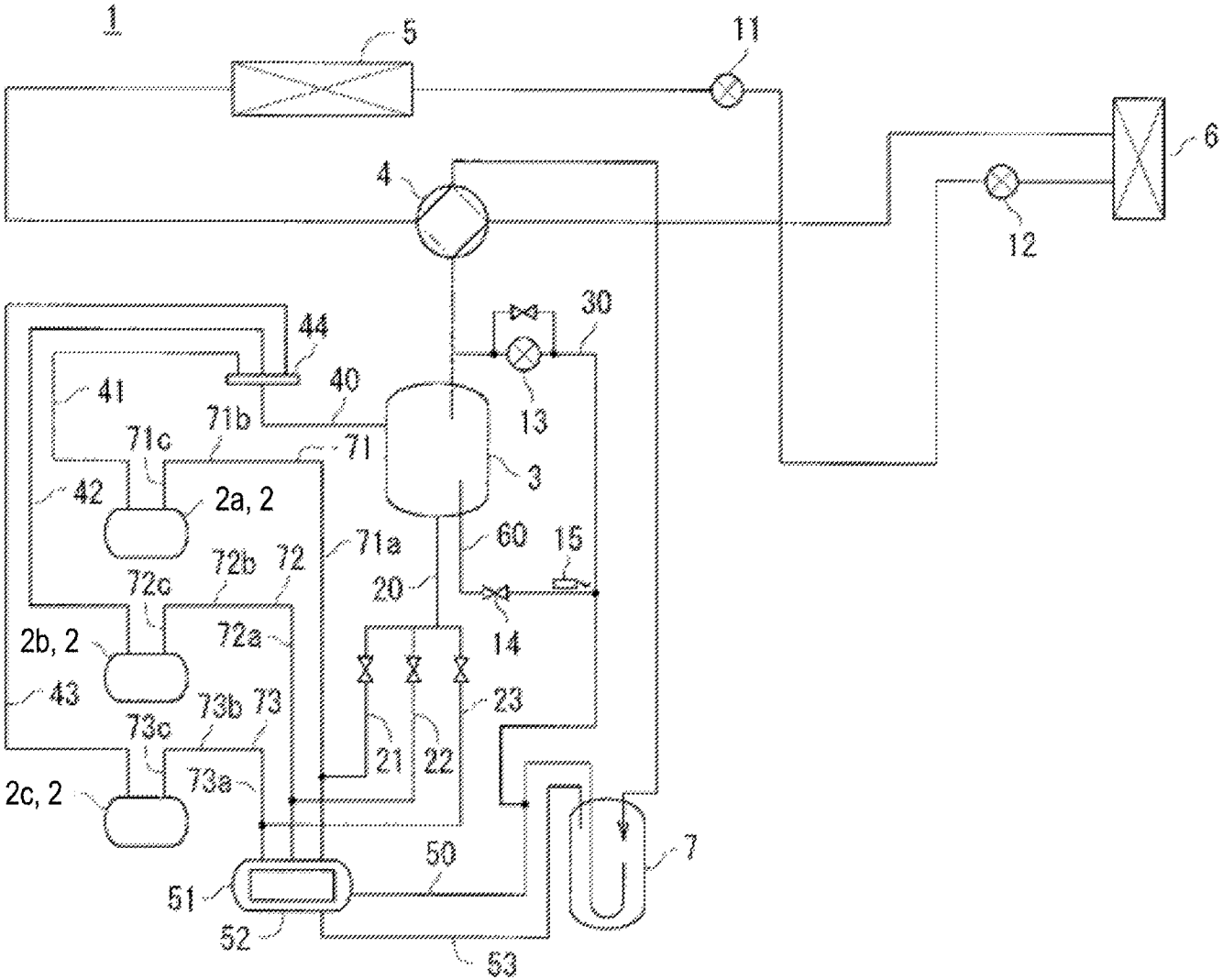
FIG. 1 shows a simplified circuit diagram of a refrigerant circuit of a heat pump according to an embodiment of the present invention.

FIG. 1 is a simplified circuit diagram illustrating a refrigerant circuit of a heat pump according to an embodiment of the present invention.

The heat pump 1 has an outdoor unit to perform heat exchange with outdoor air and an indoor unit to perform heat exchange with indoor air. The outdoor unit includes compressors 2 (a first compressor 2*a*, a second compressor 2*b*, and a third compressor 2*c*), an oil separator 3, a four-way valve 4, an outdoor heat exchanger 5, an accumulator 7, and an outdoor expansion valve 11. The indoor unit has an indoor heat exchanger 6 and an indoor expansion valve 12.

The first compressor 2*a*, the second compressor 2*b*, and the third compressor 2*c* is driven with a driving source such as a gas engine, for example. The three compressors 2 are configured to be driven with a single gas engine via a belt or a flywheel, or each of them may be selectively driven by providing a clutch. The compressors 2 are not limited thereto, and they may be electric compressors which can be driven electrically. A discharge path of the first compressor 2*a* (first discharge path 41), a discharge path of the second compressor 2*b* (second discharge path 42), and a discharge path of the third compressor 2*c* (third discharge path 43) are integrated with a fluid merging part 44 into a single gas path 40.

High temperature and high pressure gaseous refrigerant discharged from the compressors 2 are directed to the outdoor heat exchanger 5 or the indoor heat exchanger 6 with the four-way valve 4. During a heating operation (solid line) the four-way valve 4 delivers the gaseous refrigerant to the indoor heat exchanger 6, and during cooling operation (one-dot chain line) the four-way valve 4 delivers the gaseous refrigerant to the outdoor heat exchanger 5.

During the heating operation, the indoor heat exchanger 6 transfers heat from the refrigerant to the indoor air and causes the gaseous refrigerant to change into a liquid state with low temperature and high pressure. Then, the refrigerant is delivered to the outdoor heat exchanger 5 via the indoor expansion valve 12 and the outdoor expansion valve 11. A degree of opening of each of the indoor expansion valve 12 and the outdoor expansion valve 11 is controlled by a controller or the like where appropriate.

During the heating operation, the outdoor expansion valve 11 expands the liquid refrigerant and causes the liquid refrigerant to change into a liquid state (fog state) with low temperature and low pressure. Then, the outdoor heat exchanger 5 transfers heat from the outdoor air to the refrigerant and causes the refrigerant to change into a gaseous state with low temperature and low pressure. After passing through the outdoor heat exchanger 5, the refrigerant passes through the four-way valve 4 and is delivered to a suction path 50 of the compressors 2.

The accumulator 7 is provided in a path between the four-way valve 4 and the compressors 2. The accumulator 7 temporarily stores the gaseous refrigerant. The gaseous refrigerant contains a small amount of a liquid refrigerant. These are separated in the accumulator 7, and the liquid refrigerant is accumulated in the accumulator 7.

The suction path 50 connecting the accumulator 7 and the compressors 2 has the branch part 51 connected to a plurality of paths and is branched into three paths (a first suction path 71, a second suction path 72, and a third suction path 73) via the branch part 51. The first suction path 71, the second suction path 72, and the third suction path 73 are connected to the first compressor 2*a*, the second compressor 2*b*, and the third compressor 2*c*, respectively. The structure in the vicinity of the suction path 50 will be described in detail with reference to FIG. 2 later.

A filter 52 is housed in the branch part 51 to adsorb a foreign matter contained in the refrigerant. By providing the filter 52, dirt from the refrigerant and oil can be removed as well as the refrigerant and the oil can be kept clean. In addition, a branch part 51 from which the path branches can handle multiple paths at a single location, this makes it possible to prevent extra filters 52 from being provided.

On the other hand, during a cooling operation, the high temperature and high pressure gaseous refrigerant discharged from the compressors 2 are delivered via the four-way valve 4 to the outdoor heat exchanger 5 which performs heat exchange with the outdoor air to bring the refrigerant into a low temperature and high pressure liquid state. The refrigerant having passed through the outdoor heat exchanger 5 is brought into a low temperature and low pressure liquid state (fog state) by passing through the indoor expansion valve 12. Then, the refrigerant is delivered to the indoor heat exchanger 6 which performs heat exchange with the indoor air to bring the refrigerant into a low temperature and low pressure gaseous state. The refrigerant delivered from the indoor heat exchanger 6 is then delivered to the suction path 50 of the compressors 2 after passing through the four-way valve 4 and the accumulator 7.

The oil separator 3 is provided between a discharge path of the compressors 2 and the four-way valve 4. The oil separator 3 separates oil contained in the refrigerant. The oil separator 3 is connected to an oil return piping 20 (as an example of a first piping) for supplying the separated oil to the compressors 2. The oil return piping 20 is branched into three pipings, a first oil return piping 21, a second oil return piping 22, and a third oil return piping 23, which correspond to the first suction path 71, the second suction path 72, and the third suction path 73, respectively. Specifically, the first oil return piping 21, the second oil return piping 22, and the third oil return piping 23 are connected to the first suction path 71, the second suction path 72, and the third suction path 73, respectively. The first oil return piping 21, the second oil return piping 22, and the third oil return piping 23 may be each provided with a solenoid valve or the like to control a supply of oil separately.

The oil separator 3 is also connected to a bypass circuit 30 thorough which the separated gas refrigerant (hot gas) is delivered. The bypass circuit 30 is connected in the suction path 50 between the accumulator 7 and the branch part 51. A bypass valve 13 (as an example of a valve), which controls the degree of valve opening and adjusts the flow rate of the gaseous refrigerant to be delivered, is provided in the bypass circuit 30.

In addition, an oil path 60 independent of the oil return piping 20, through which oil passes, is connected to the oil separator 3. The oil path 60 is connected to the bypass circuit 30, and by causing oil to pass through the oil path 60, oil can be delivered to the filter 52 housed in the branch part 51. By delivering an adequate amount of oil, performance of adsorbing debris of the filter 52 can be improved. An oil sensor 15 to detect the amount of oil passing through the oil path 60 and an oil valve 14 to control the delivery of oil are provided in the oil path 60. By providing the oil path 60, while the amount of oil can be detected by the oil sensor 15, oil can be delivered to the filter through the bypass circuit 30.

A second piping 53, which returns oil to the accumulator 7, is connected to the branch part 51. Oil stored in the branch part 51 is delivered through the second piping 53 and accumulated in the accumulator 7.

In the heat pump 1, there is a case where oil is stored in the accumulator 7 while a system is turned off. According to this embodiment, the suction path 50 reaching the compressors 2 is connected to the bypass circuit 30. Even if oil is stored in a piping of the accumulator 7 when getting started, since the gaseous refrigerant flowing in from the bypass circuit 30 is mixed with oil, this makes it possible to prevent oil from rushing into the compressors 2 and damaging the same.

Figure 2:
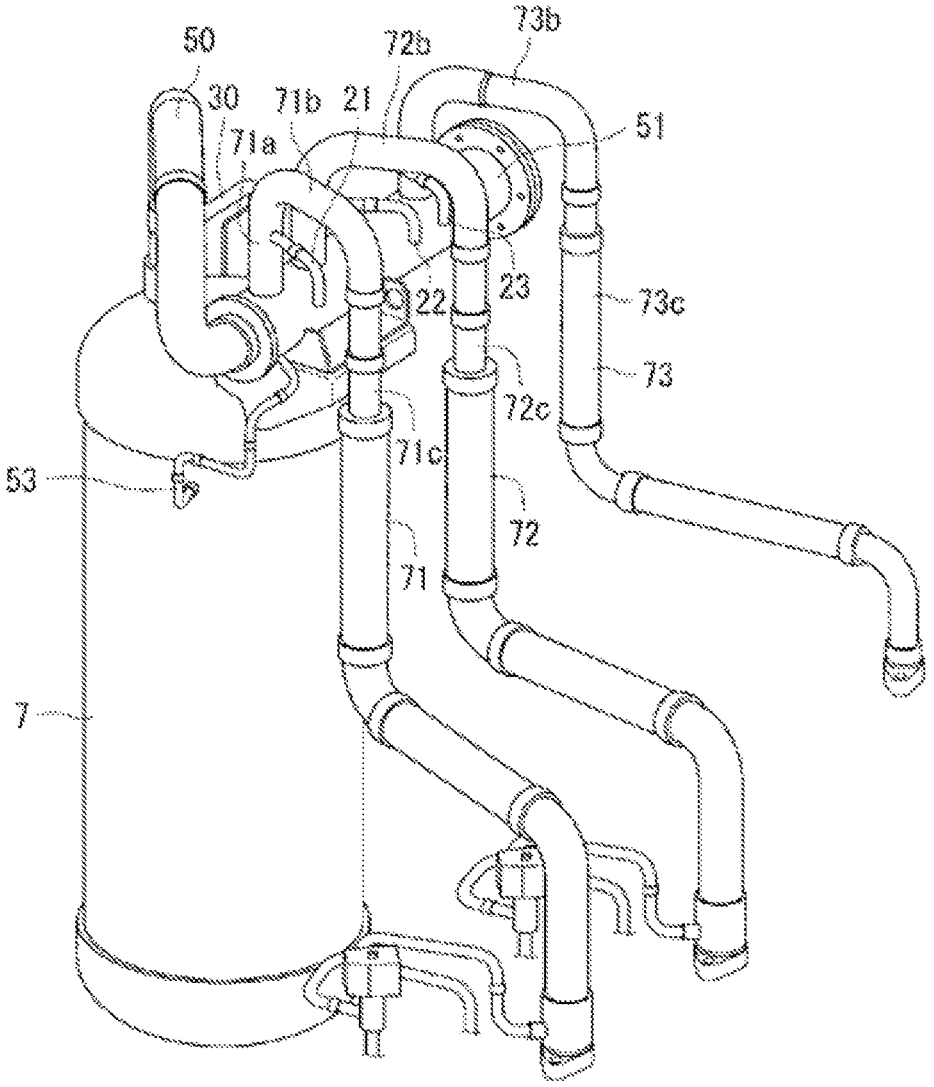
FIG. 2 shows a schematically perspective view illustrating a structure in the vicinity of an accumulator and a suction path.
Figure 3:
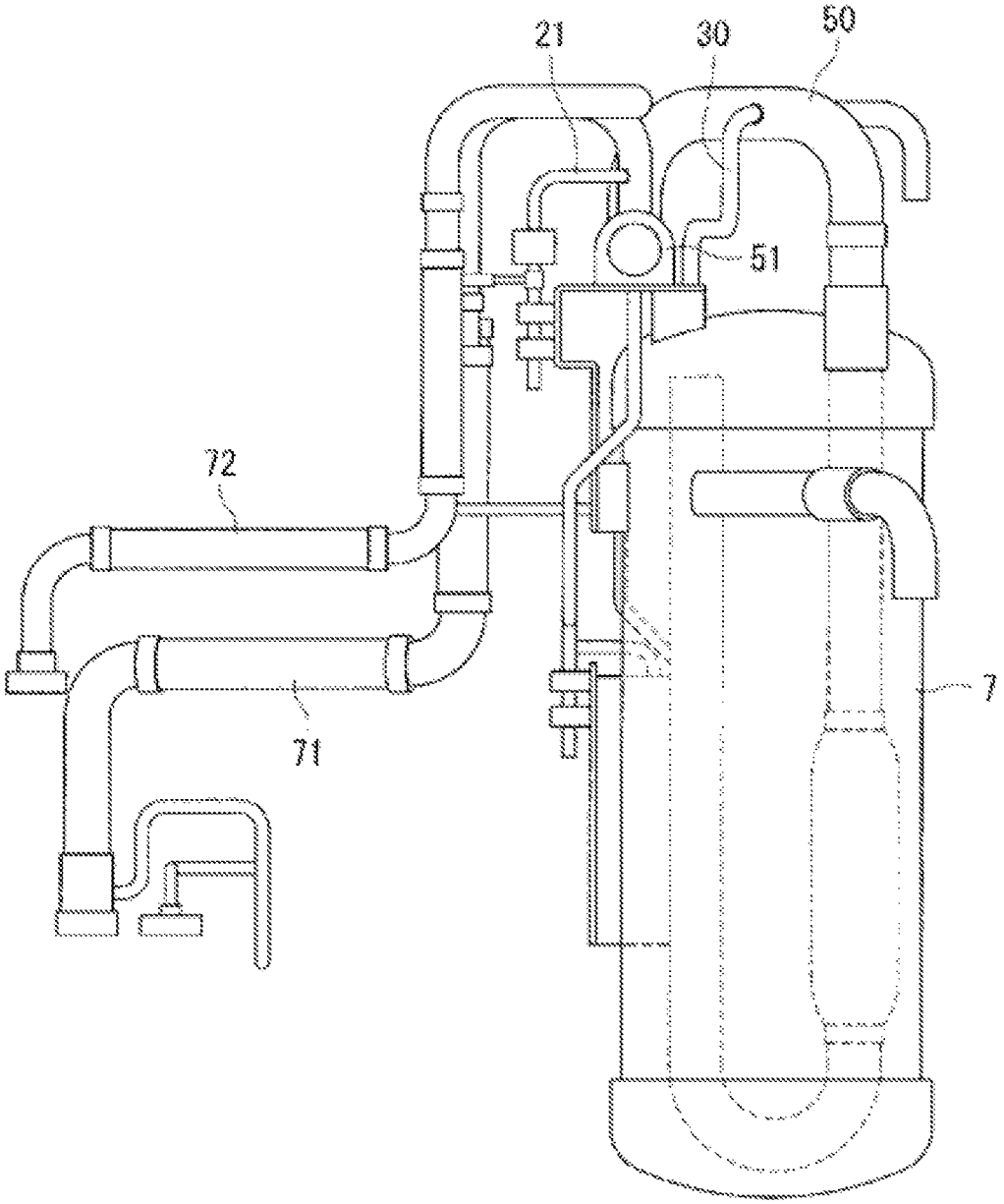
FIG. 3 shows a schematically side view illustrating a structure in the vicinity of the accumulator and the suction path.

FIG. 2 is a schematically perspective view illustrating a structure in the vicinity of the accumulator and the suction path, and FIG. 3 is a schematically side view illustrating a structure in the vicinity of the accumulator and the suction path. FIG. 3 shows the accumulator 7 in a transparent manner for the convenience of viewing.

The accumulator 7 encloses a U-shaped tube, and the refrigerant flowing into the accumulator 7 passes through the inside of the U-shaped tube. Oil delivered through the second piping 53 is once stored outside the U-shaped tube. An orifice (small hole) is provided on the lower side of the U-shaped tube, so that the refrigerant and oil stored outside the U-shaped tube are gradually drawn into the inside of the U-shaped tube through the orifice. A discharge port of the U-shaped tube is connected to the suction path 50 upside the accumulator 7.

As mentioned above, the suction path 50 to deliver the refrigerant to the compressors 2 leads from the accumulator 7. The suction path 50 has the branch part 51 located above the accumulator 7 in the vertical direction. The first suction path 71 leading from the branch part 51 has a first upward extending part 71*a* extending upward, a first downward extending part 71*c* extending downward, and a first connection part 71*b* connecting between the first upward extending part 71*a* and the first downward extending part 71*c*. The first oil return piping 21 is connected to the first upward extending part 71*a*. A shape of the first connection part 71*b* is not limited and may be variable to some extent in the vertical direction.

The first suction path 71 has the first upward extending part 71*a*, the first connection part 71*b*, and the first downward extending part 71*c* in the stated order along the refrigerant delivery direction between the upstream side where the branch part 51 is located and the downstream side where the first compressor 2*a* is located. Upon the system gets started, although the refrigerant (oil) flows along the delivery direction, but while the system is turned off, the refrigerant moves down by gravity. Namely, the refrigerant returns upstream at the first upward extending part 71*a*, it does not move significantly at the first connection part 71*b*, as well as it moves downstream at the first downward extending part 71*c*. Therefore, while the compressors 2 are stopped, oil flowing into the first upward extending part 71*a* returns to the accumulator 7, and thus it is possible to prevent oil from flowing into the compressors 2. Furthermore, since oil flowing in through the first oil return piping 21 naturally flows downward, it is possible to prevent from producing an oil lump.

Furthermore, the second piping 53 is connected to the branch part 51 located below the oil return piping 20 (the first oil return piping 21) in the vertical direction. Accordingly, in a state where the compressors 2 are stopped, oil flowing in through the oil return piping 20 returns to the accumulator 7 through the branch part 51 and the second piping 53. Namely, this makes it possible to be such a structure through which oil naturally returns without providing an additional power source.

Each of the second suction path 72 and the third suction path 73 has a shape substantially similar to the first suction path 71, and the second suction path and the third suction path respectively have the second upward extending part 72*a* and the third upward extending part 73*a*, which correspond to the first upward extending part 71*a*, and the second connection part 72*b* and the third connection part 73*b*, which correspond to the first connection part 71*b*, as well as the second downward extending part 72*c* and the third downward extending part 73*c*, which correspond to the first downward extending part 71*c*. Since the flow of the refrigerant in the second suction path 72 and the third suction path 73 is the same as in the first suction path 71, a detail explanation thereof is omitted except that they are configured so that oil can return to the accumulator 7 while the compressors 2 are stopped.

Next, the control of the degree of opening of the bypass valve 13 when the system gets started will be explained below with reference to FIG. 4.

Figure 4:
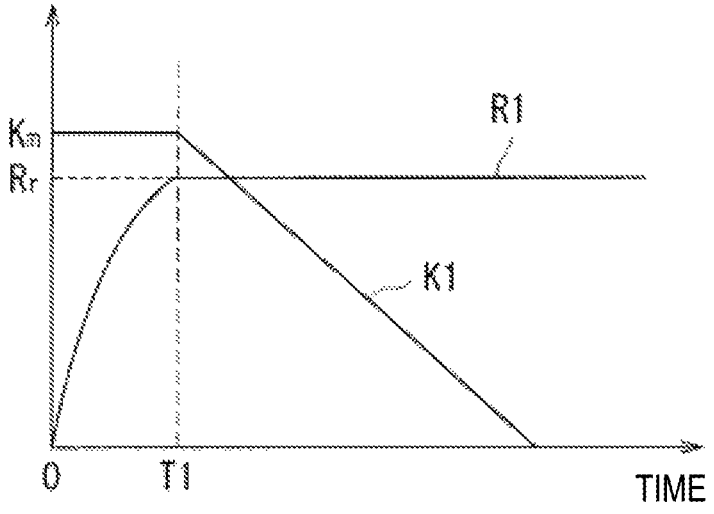
FIG. 4 shows an explanatory diagram illustrating variations of a degree of opening of a bypass valve and a rotation speed of a compressor over time.

FIG. 4 is an explanatory diagram illustrating variations of the degree of opening of the bypass valve and a rotation speed of a compressor over time.

FIG. 4 shows a degree of valve opening change characteristic line K1, which indicates a time-change in the degree of valve opening of the bypass valve 13, and a rotation speed change characteristic line R1, which indicates a time-change in the rotation speed of the compressors 2, and the horizontal axis represents a lapse of time. With respect to the degree of valve opening change characteristic line K1, the higher the vertical axis goes, the greater the degree of opening becomes, as well as with respect to the rotation speed change characteristic line R1, the higher the vertical axis goes, the greater the rotation speed becomes. Taking into account of variation to some extent, the rotation speed of the compressors 2 may be a rough value, and thus a slight error is allowed.

In FIG. 4, a time when the system gets started is shown as "0". At time "0", the bypass valve 13 is set to an upper limit degree of valve opening (upper limit degree of valve opening Km), and the rotation speed of the compressors is set to zero. The rotation speed of the compressors 2 increases over time, and it reaches a stable rotation speed (stable rotation speed Rr) at time "T1." The stable rotation speed Rr is maintained thereafter. The bypass valve 13 is set to the upper limit degree of valve opening Km until the time "T1", and after the time "T1", the valve is gradually closed (the degree of valve opening is reduced).

Namely, the bypass valve 13 is controlled so that the degree of valve opening thereof is reduced over time after the heat pump 1 is started. While the bypass valve 13 is opened, as the gaseous refrigerant is delivered to the suction path 50 through the bypass circuit 30, it is possible to prevent excessive oil from flowing into. After the lump of oil is diminished by flowing oil gradually, by decreasing the delivery amount of the gaseous refrigerant to control so that the proper amount of oil is delivered, a normal operating environment of the system can be returned.

FIG. 4 shows a part of an operation transition when the system gets started, and the rotation speed of the compressors 2 may be controlled to exceed the stable rotation speed Rr as appropriate thereafter. Furthermore, although the bypass valve 13, in which the degree of valve opening is linearly decreased, is illustrated as an example, it is not limited thereto, and the degree of valve opening may be decreased in a step by step manner or the like if only the bypass valve 13 is closed finally.

It should be noted that embodiments disclosed above are exemplary in all respects, and the invention is not limitedly construed on a basis thereof. Therefore, the technical scope of the present invention should not be construed based on only above described embodiments but be defined based on the statement of the claims. Furthermore, any changes and modifications within the meaning and range equivalent to the claims fall within the scope of the invention.

This application claims the benefit of priority to Japanese Patent Application No. 2020-053960 filed as of Mar. 25, 2020. The entirety thereof is incorporated herein by reference. In addition, the entirety of the references cited is incorporated herein by reference.

DESCRIPTION OF REFERENCE NUMERALS

1 Heat pump
2 Compressor
3 Oil separator
4 Four-way valve
5 Outdoor heat exchanger
6 Indoor heat exchanger
7 Accumulator
11 Outdoor expansion valve
12 Indoor expansion valve
13 Bypass valve (an example of a valve)
14 Oil valve
15 Oil sensor
20 Oil return piping (an example of a first piping)
30 Bypass circuit
40 Gas path
44 Fluid merging part
50 Suction path
51 Branch part
52 Filter
53 Second piping
60 Oil path
71 First suction path
71*a* First upward extending part (an example of an upward extending part)
71*b* First connection part (an example of a connection part)
71*c* First downward extending part (an example of a downward extending part)
72 Second suction path
72*a* Second upward extending part (an example of an upward extending part)
72*b* Second connection part (an example of a connection part)
72*c* Second downward extending part (an example of a downward extending part)
73 Third suction path
73*a* Third upward extending part (an example of an upward extending part)
73*b* Third connection part (an example of a connection part)
73*c* Third downward extending part (an example of a downward extending part)

The invention claimed is:

1. A heat pump comprising:
a compressor;
an oil separator provided in a discharge path of the compressor;
an accumulator connected to the compressor via a suction path; and
a first piping configured to deliver oil separated with the oil separator to the compressor, wherein:
the heat pump comprises a bypass circuit configured to deliver a gaseous refrigerant separated with the oil separator,
the bypass circuit is connected to the suction path,
the first piping is connected to the suction path above the accumulator in a vertical direction,
the suction path has an upward extending part extending upward, a downward extending part extending downward, and a connection part to connect the upward extending part and the downward extending part,
the upward extending part, the connection part, and the downward extending part are provided in the suction path in a stated order from an upstream side along a delivery direction of a refrigerant, and
the first piping is connected to the upward extending part.

2. The heat pump according to claim 1, wherein:
a valve is provided in the bypass circuit, and
the valve is configured to be controlled so that a degree of opening of the valve is decreased over time after the heat pump is started.

3. The heat pump according to claim 1, wherein:
the suction path has a plurality of paths and a branch part that connects to the plurality of paths,
a second piping configured to return oil to the accumulator is connected to the branch part, and
the second piping is connected to the suction path below the first piping in the vertical direction.

4. The heat pump according to claim 3, wherein a filter is housed in the branch part.

5. The heat pump according to claim 4 further comprising:
an oil path through which oil delivered from the oil separator flows; and
an oil sensor configured to detect an amount of oil flowing through the oil path, and
wherein the oil path is connected to the bypass circuit.

* * * * *